US005540272A

United States Patent [19]

Freeman

[11] Patent Number: 5,540,272

[45] Date of Patent: Jul. 30, 1996

[54] DIE CAST VACUUM VALVE

[76] Inventor: Lewis G. Freeman, 1509 Pontiac Dr., Kokomo, Ind. 46902

[21] Appl. No.: 312,324

[22] Filed: Sep. 26, 1994

[51] Int. Cl.[6] ..... B22D 17/14; B22D 17/20

[52] U.S. Cl. ..... 164/253; 164/305

[58] Field of Search ..... 164/254, 253, 164/305, 410

[56] References Cited

U.S. PATENT DOCUMENTS

| | | | |
|---|---|---|---|
| 3,070,857 | 1/1963 | Venus . | |
| 3,590,114 | 6/1971 | Uhlig | 264/328 |
| 4,027,726 | 6/1977 | Hodler | 164/305 |
| 4,099,904 | 7/1978 | Dawson | 425/563 |
| 4,463,793 | 8/1984 | Thurner | 164/155 |
| 4,577,670 | 3/1986 | Moore | 164/155 |
| 4,680,003 | 7/1987 | Schulte et al. | 425/206 |
| 4,938,274 | 7/1990 | Iwamoto et al. | 164/305 X |
| 5,101,882 | 4/1992 | Freeman | 164/457 |

FOREIGN PATENT DOCUMENTS

| | | | |
|---|---|---|---|
| 57-81949 | 5/1982 | Japan . | |
| 58-97478 | 6/1983 | Japan . | |
| 62-151258 | 7/1987 | Japan | 164/305 |
| 346361 | 6/1960 | Switzerland . | |

*Primary Examiner*—J. Reed Batten, Jr.
*Attorney, Agent, or Firm*—Christopher A. Taravella

[57] ABSTRACT

A vacuum valve includes a first and second die block both adapted to be secured to a die of a die pair. A slot is in one of the die blocks in fluid communication with a mold cavity. A valve member is movable between a first position permitting fluid flow through the slot in a second position inhibiting fluid flow through the slot. A power operated actuator includes a reciprocal movable output member. A gear drive mechanism is coupled with the output member and with the valve for changing movement of the actuator into movement of the valve member. A controller controls the reciprocation of the actuating member.

11 Claims, 4 Drawing Sheets

22

DIE CAST VACUUM VALVE

BACKGROUND OF THE INVENTION

The present invention relates generally to vacuum die casting machines and, more particularly, to an improved vacuum valve for evacuating the die cavity prior to injection of a molten casting material into the cavity.

As is known in the vacuum die casting industry, the removal of air and other gasses from the die cavity prior to injection of a molten metal shot results in improved flow of the molten material into the die cavity which, in turn, produces a casting having improved grain structure and surface finish. Evacuation of the die cavity is generally accomplished by a venting device that is in fluid communication with the die cavity. Several different types of venting devices are disclosed by the following U.S. Pat. Nos.: 2,785,448; 2,867,869; 2,904,861; 3,070,857; 3,433,291; 4,027,726; 4,729,422; 4,779,666; 4,782,886; 4,809,767; 4,825,933; 4,832,109; and 5,101,882. While the above patents disclose venting devices that appear to perform satisfactorily for their intended purpose, designers are always striving to improve the art.

SUMMARY OF THE INVENTION

Accordingly, the present invention is directed to an improved vacuum valve for use in a vacuum die casting apparatus which can be directly mounted to, or integrated into, the casting dies or die blocks between the die cavity and a vacuum source.

As such, it is an object of the present invention to provide a vacuum valve having a flow passageway between the die cavity and the vacuum source, a shut-off piston movable between a first position permitting flow through the passageway and a second position inhibiting flow through the passageway, a power-operated actuator, a geared drive mechanism coupling the actuator to the shut-off piston, and a controller for controlling actuation of the actuator for controlling movement of the shut-off piston between its first and second positions.

As a related object, the geared drive mechanism reduces the actuating force required to reciprocate the shut-off piston between its first and second positions while permitting the speed at which the shut-off piston reciprocates to be varied in relation to the length of stroke or travel of the actuator.

As a further object, the vacuum valve of the present invention also includes a spring-biased cushioning member positioned to contact the shut-off piston upon movement thereof to its second position for preventing excessive wear while maintaining a substantially fluid-tight seal between the shut-off piston and the passageway for preventing the continued flow of molten material toward the vacuum source.

Further objects, features and advantages of the present invention will become apparent to those skilled in the art from the following written description when taken in conjunction with the accompanying drawings and subjoined claims.

DETAILED DESCRIPTION OF THE PREFERRED EMBODIMENT

In general, the present invention is directed to an improved vacuum valve which is operably installed in fluid communication between the die cavity and a remote vacuum source in a vacuum die casting apparatus. To this end, the present invention is directed to a modified version of the vacuum valve disclosed in commonly owned U.S. Pat. No. 5,101,882, the entire disclosure of which is expressly incorporated herein by reference. In particular, the vacuum valve of the present invention provides a unique actuation mechanism for controlling movement of a shut-off piston that is used to control the flow of trapped gases and molten casting material through the vacuum valve. Thus, while the novel features of the present invention are shown incorporated into a specific vacuum valve construction, it will be appreciated that such features are readily applicable to virtually any conventional vacuum valve used in a vacuum die casting apparatus for the manufacture of die cast components. As used herein, the term "fluid" is used to encompass the flow through the vacuum valve of both gases and liquids in the manner more specifically set forth hereafter.

Figure 1:
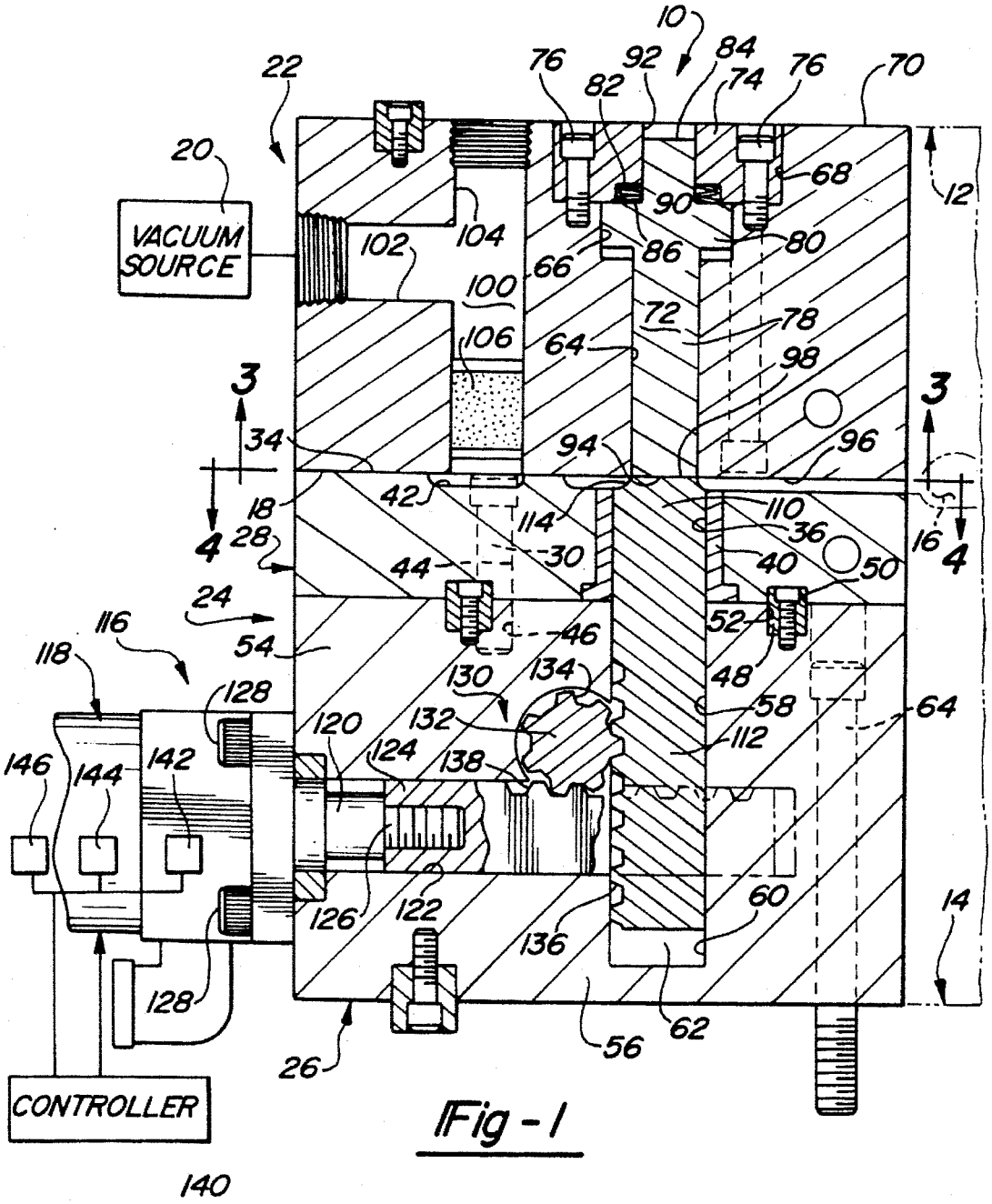
FIG. 1 is a partial sectional view of a vacuum valve for use with a vacuum die casting apparatus and which is constructed in accordance with a preferred embodiment of the present invention.

With particular reference to FIG. 1, a vacuum valve 10 is shown in association with a die set including a cover die 12 and an ejector die 14 that are partially illustrated in phantom lines. A die cavity 16 is formed between the mating dies and is separated by a parting line or plane 18 which is formed between cover die 12 and ejector die 14. Vacuum valve 10 is operably positioned between die cavity 16 and a vacuum source 20 for selectively regulating the flow of gases evacuated from die cavity 16. Additionally, vacuum valve 10 is operable to assist in drawing molten material into die cavity 16 while concomitantly preventing the flow of such molten material therethrough to vacuum source 20.

Vacuum valve 10 has two primary components, namely, a cover die block 22 that is connected to cover die 12, and an ejector die block 24 that is coupled to ejector die 14. As clearly seen, cover die block 22 and ejector die block 24 are adapted to form the housing of vacuum valve 10. While cover die block 22 and ejector die block 24 are shown to be individual components that are suitably coupled to cover die 12 and ejector die 14, respectively, it is to be understood that the elements associated therewith may be incorporated directly into dies 12 and 14 so as to make vacuum valve 10 an integral part thereof.

With continued reference to FIG. 1, ejector die block 24 is shown to include a piston block 26 and an ejector plate 28 that are suitably secured together, such as by cap-screw fasteners 30. A runner slot 32 is formed in an outer planar surface 34 of ejector plate 28 for enabling an overflow runner to be formed therein when die cavity 16 is filled with molten material. In addition, a bore 36 is formed through ejector plate 28 that is in fluid communication with slot 32 and which provides a passageway for reciprocable movement of a valve member. As will be detailed with greater specificity, the movable valve member is a shut-off piston 38 that is supported for rectilinear non-rotational movement between the raised position (shown) and a retracted position relative to slot 32. A sleeve bushing 40 is positioned in bore 36 for supporting and guiding reciprocal movement of shut-off piston 38. Ejector plate 28 is also formed to include an overflow trough 42 which fluidly communicates with runner slot 32 for providing a sump chamber in which residual molten material can be collected in the unlikely event that shut-off piston 38 does not completely seal off slot 32. Thus, ejector plate 28 provides a collection area for permitting easy removal of the overflow molten material upon solidification thereof. As noted, ejector plate 28 is secured to piston block 26 in any suitable manner such as, for example, the use of threaded cap screws 30 received within alignable sets of threaded bores 44 and 46 formed therebetween. In addition, keys 48 may be positioned in alignable slots 50 and 52 formed in ejector plate 28 and piston block 26, respectively, to aid in precisely positioning the blocks with respect to one another.

With continued reference to FIG. 1, piston block 26 is shown to include upper and lower plates 54 and 56, respectively, having bores 58 and 60 that are alignable for defining a common piston chamber 62. Preferably, upper and lower plates 54, 56 are held together by a plurality of fasteners 64. In addition, piston chamber 62 is alignable with bore 36 formed in ejector plate 28. While disclosed as being formed as a two-piece assembly, it will be understood that piston block 26 could likewise be fabricated as a single component.

Cover die block 22 includes a stepped bore defined by a first bore section 64 communicating with parting line 18, a second bore section 66, and a third bore section 68 communicating with an external top surface 70 of cover die block 22. The three bore sections cumulatively define a piston chamber in which a spring-biased cushioning piston 72 is disposed for limited reciprocal movement along a common axis to that of shut-off piston 38. Cushioning piston 72 is retained in the stepped bore via a retainer block 74 that is screwed in third bore section 68 via suitable threaded fasteners 76. As such, an elongated segment 78 of cushioning piston 72 is retained in first bore section 64 while a radial flange 80 on cushioning piston 72 is retained in second bore section 66. In addition, one or more biasing members, such as belleville washers 82, are positioned peripherally around a stub segment 84 of cushioning piston 72 and act between an upper surface 86 of radial piston flange 80 and a recessed surface 90 formed by a counterbored chamber in retainer block 74. As such, stub segment 84 is supported for reciprocal movement with cushioning piston 72 within a central bore 92 formed through retainer block 74. Spring washers 82 are adapted to normally bias cushioning piston 72 downwardly such that its terminal end 94 extends through first bore section 64 and into runner slot 32 beyond lower planar surface 96 of cover die block 22.

Upon movement of shut-off piston 38 toward its raised "blocking" position shown, its terminal end 98 contacts end 94 of cushioning piston 72. As such, cushioning piston 72 is forcibly urged to move in opposition to the biasing exerted thereon by spring washers 82, thereby damping the otherwise abrupt engagement of end 98 of shut-off piston 38 with surface 96 of cover die block 22 as shut-off piston 38 tightly seals and closes the parting line 18 at runner slot 32. As shut-off piston 38 moves upward, cushioning piston 72 also moves upward against the biasing of spring washers 82 such that end portion 94 of cushioning piston 72 becomes flush with surface 96 of the cover die block 22. At this time, shut-off piston 38 contacts cover block surface 96 peripherally about cushioning piston 72 sealing shut-off piston 38 with cover die block 22 to terminate flow through slot 32. Once shut-off piston 38 is retracted from contact with cushioning piston 72, washers 82 bias cushioning piston 72 back to its normal or original position where end portion 94 of cushioning piston 72 extends outwardly past surface 96 of cover die block 22.

A vacuum passageway 100 is formed in cover die block 22 which communicates with overflow trough 42 and is coupled to vacuum source 20 via vacuum port 102. Vacuum passageway 100 also includes a venting port 104 for connection, if required, to a suitable venting device. In operation, vacuum source 20 is adapted to draw air and fluids from die cavity 16 through vacuum valve 10 via slot 32, overflow trough 42 and passageway 100 under specific vacuum casting conditions. An optional filter 106 may be positioned within vacuum passageway 100 to filter the gases and fluids exiting die cavity 16. Additionally, sensors (not shown) may be used in association with filter 106 to monitor gas flow therethrough for signalling when filter 106 is clogged which, in turn, is indicative of the undesirable condition that inadequate vacuum is being drawn from die cavity 16.

Shut-off piston 38 is an elongated cylindrical component having an upper ram portion 110 and a lower toothed rack portion 112. Ram portion 110 includes a cut-out portion 114 on its terminal end 98 for assisting in lifting the molded runner upon ejection of the die cast component. To provide means for moving shut-off piston 38 between its retracted and raised positions, an actuation mechanism 116 is provided. In particular, actuation mechanism 116 includes a power-operated actuator 118, such as a hydraulic cylinder or the like, having a plunger shaft 120 extending therefrom that is supported in a channel 122 formed in piston block 26 for reciprocating non-rotational movement relative thereto. A toothed rack member 124 is suitably coupled, such as by threaded fastener 126, to plunger shaft 120 for concurrent movement therewith. As shown, power cylinder 118 is secured to piston block 26 by fasteners, such as bolts 128. As is conventional, power cylinder 118 is suitably connected to a controlled pressurized fluid source (hydraulic fluid or air) for selectively controlling the direction and magnitude of linear reciprocatory movement of plunger shaft 120 and, in turn, of toothed rack 124. Moreover, toothed rack 124 is oriented so as to reciprocate in a plane that is generally orthogonal with respect to the plane through which shut-off piston 38 reciprocates. Moreover, toothed rack 124 is offset from shut-off piston 38 and does not directly engage it.

To provide means for changing the reciprocatory movement of toothed rack 124 into reciprocatory movement of shut-off piston 38, a geared drive mechanism 130 is provided which includes an elongated pinion 132 that is supported from piston block 26. Pinion 132 has gear teeth 134 formed on its outer peripheral surface that are in continuous meshing contact with both gear teeth 136 on rack portion 112 of shut-off piston 38 and gear teeth 138 on toothed rack 124. As such, forward stroke travel (extension) of plunger shaft 120 causes pinion 132 to rotate in a counterclockwise direction (FIG. 1) which, in turn, results in upward movement of shut-off piston 38 toward its raised "blocking" position. Conversely, rearward stroke travel (retraction) of plunger shaft 120 causes pinion 132 to rotate in a clockwise direction which, in turn, results in downward movement of shut-off piston 38 toward its retracted position. Such an arrangement permits the speed and magnitude of movement of shut-off piston 38 to be selected based on the ratio of pinion revolutions to length of travel of toothed rack 124. Moreover, the number of teeth on each toothed component can be selected to permit further variations in speed and travel while still maintaining the required meshed engagement. Finally, geared drive mechanism 130 reduces the actuating force required from cylinder 118 to lift shut-off piston 38, thereby permitting use of smaller and less costly cylinders and related hardware.

To control actuation of cylinder 118, an electronic controller 140 and a series of limit switches 142,144 and 146 are used so as to controllably regulate movement of shut-off piston 38 in coordination with the evacuation of gases and the injection of molten material into die cavity 16.

For purposes of clarity and by way of example, a brief explanation of the vacuum die casting process is as follows. As is conventional, die cavity 16 is filled by molten casting material entering die cavity 16 from a shot sleeve. A hydraulic shot cylinder pushes the molten casting material retained in the shot sleeve into die cavity 16. A shot bar, coupled with the shot cylinder, covers the injection port in the shot sleeve for enabling the molten casting material in the shot sleeve to be injected into die cavity 16. As this occurs, a control signal is sent from controller 140 to flow control valving associated with cylinder 118 for moving shut-off piston 38 toward parting line 18, as illustrated in FIG. 1. As shut-off piston 38 reaches parting line 18, limit switch 142 is tripped for transmitting a signal back to controller 140 indicating that shut-off piston 38 has reached or is very near to parting line 18. In response to this signal, controller 140 transmits a control signal to the vacuum die casting apparatus to enter into a fast shot mode and to inject the molten casting material into die cavity 16. As this occurs, actuation of cylinder 118 continues for quickly driving shut-off piston 38 toward cushion piston 72. Shut-off piston 38 closes off runner slot 32 for stopping the flow of molten casting material past shut-off piston 38, so as to prevent overflow and yet still ensure complete evacuation of gases within dies cavity 16 and venting passage 100. This evacuation process also assists in drawing molten casting material into die cavity 16. As previously noted, if cushioning piston 72 was not utilized, quick movement of shut-off piston 38 would abruptly contact cover die block surface 96 in a manner that could potentially reduce its useful service life.

As shut-off piston 38 contacts cushioning piston 72 and cover die block surface 96, vacuum passageway 100 is sealed off and a second limit switch 144 is activated for transmitting a signal to controller 140 indicating that shut-off piston 38 has reached the fully raised "blocking" position. After receiving this signal, the system has two option. First, controller 140 can transmit a signal to the vacuum casting apparatus which indicates that die cavity 16 is completely filled so as to stop further injection of the casting material and return the apparatus to its starting position. Controller 140 then transmits a signal to cause cylinder 118 to retract plunger shaft 120, thereby returning shut-off piston 38 to its retracted position. Once this occurs, limit switch 146 is triggered for transmitting a signal to controller 140 indicating that cylinder 118 has reached its starting position. Second, controller 140 can transmit a signal to the vacuum casting apparatus which indicates that die cavity 16 is full and to stop further injection of molten material and deactivate cylinder 118. At this time, dies 12 and 14 would be separated and cylinder 118 would again be actuated by controller 140 for driving shut-off piston 38 upwardly beyond the limit where shut-off piston 38 contacts cushioning piston 72, thus moving a lower surface of notch 144 outwardly to assist in ejecting the runner from slot 32 and enabling the cast component to be removed from die cavity 16.

Figure 2:
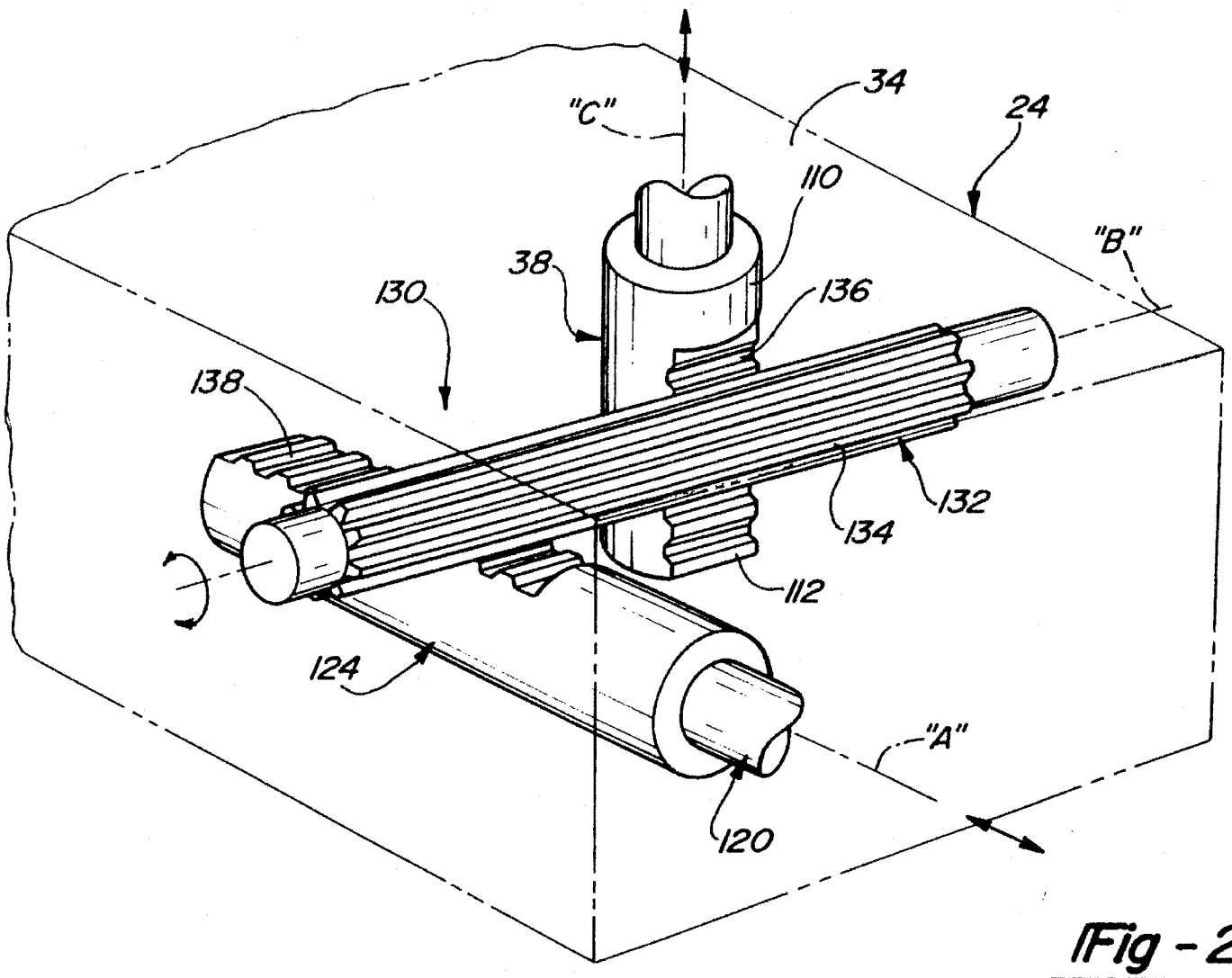
FIG. 2 is a somewhat schematic perspective view of the ejector die block of the vacuum valve which illustrates the orientation of directions of movement for the components associated with the geared drive mechanism provided for moving the shut-off piston in response to actuation of the power-operated cylinder.
Figure 3:
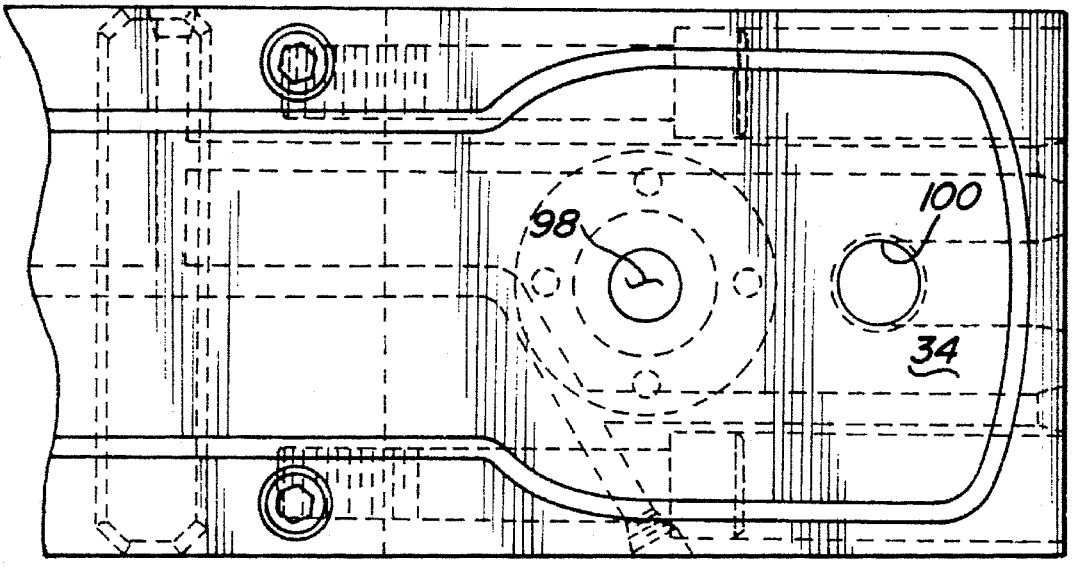
FIG. 3 is a plan view of FIG. 1 along a plane defined by the line 3—3 thereof.
Figure 4:
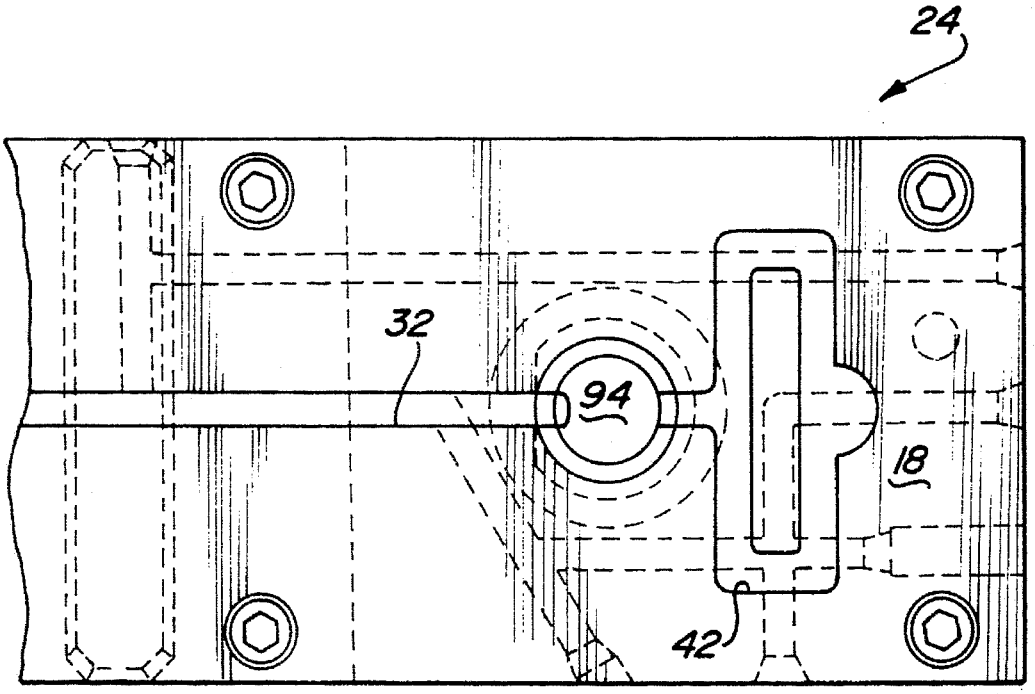
FIG. 4 is a plan view of FIG. 1 along a plane defined by the line 4—4 thereof.

With particular reference to FIG. 2, the axis of movement for each component of geared drive mechanism 130 is shown in greater detail. In general, the axis of movement for each component is oriented to be generally orthogonal with respect to the other two components. Thus, reciprocating linear movement of toothed rack 124 along axis "A" causes pinion 132 to rotate about axis "B" which, in turn, causes shut-off piston 38 to reciprocate along axis "C". Obviously, the orientation can be varied to suit the particular application as long as a non-interfering mesh is maintained between the toothed gear components.

Figure 5:
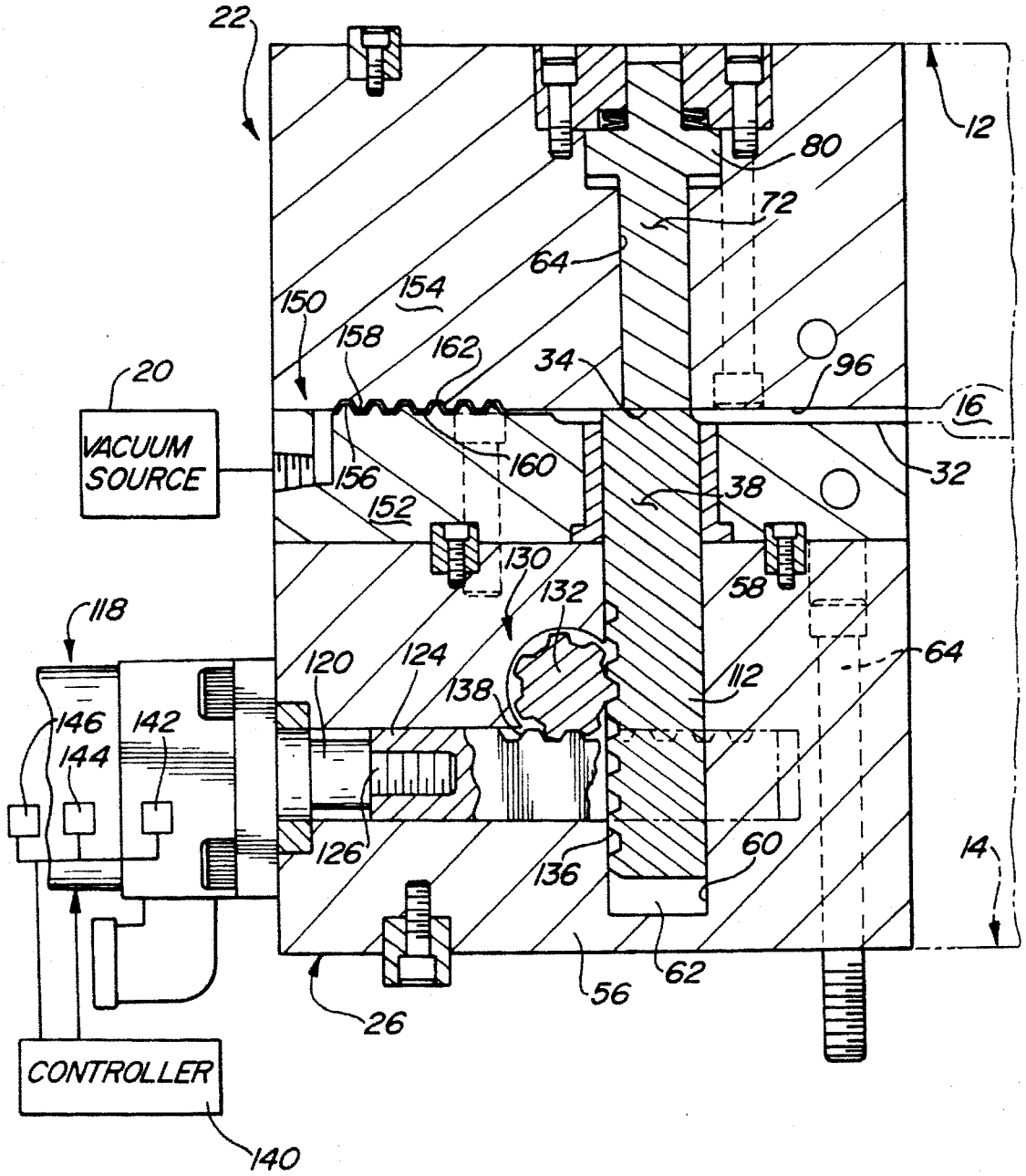
FIG. 5 is a view like FIG. 1 of an alternate embodiment of the present invention.

FIG. 5 illustrates an alternate embodiment similar to FIG. 1 with the same reference numerals identifying the same elements.

In FIG. 5, instead of filter 106, the blocks include a vent block 150. The vent block 150 provides additional protection to the venting passageway in the die casting vacuum valve system. The vent block 150 includes an ejector vent block 152 and cover vent block 154 both with alternating lands 156, 158 and grooves 160, 162 with their respective lands and grooves meshing with one another. The vent block is fully disclosed in Ser. No. 08/312,308, entitled "Die Cast Vent Block", filed Sep. 26, 1994, the specification and drawings of which are expressly incorporated herein by reference.

The foregoing discussion discloses and describes exemplary embodiments of the present invention. One skilled in the art will readily recognize from such discussion, and from the accompanying drawings and claims, that various changes, modifications and variations can be made therein without departing from the true spirit and fair scope of the invention as defined in the following claims.

What is claimed is:

1. A vacuum valve adapted to be coupled with a die pair forming a mold cavity therebetween and separated by a parting line between the die pair, said vacuum valve comprising:

a first die block adapted to be secured to one die of the die pair and including a slot in fluid communication with the mold cavity, and a valve member that is moveable between a first position permitting fluid flow through said slot and a second position inhibiting the flow of fluid through said slot;

a second die block adapted to be secured to the other die of the die pair and having a passageway in fluid communication with said slot and a vacuum source;

a power-operated actuator having a reciprocally moveable output member;

a geared drive mechanism coupling said output member of said actuator to said valve member for changing movement of said actuator output member into movement of said valve member; and a controller for controlling the reciprocation of said actuator output member.

2. The vacuum valve of claim 1 wherein said geared drive mechanism includes a first toothed member fixed to said actuator output member, a second toothed member fixed to said valve member, and a third toothed member meshingly coupled to said first and second toothed members, whereby movement of said actuator output member causes movement of said first toothed member which causes rotation of said third toothed member which causes movement of said second toothed member thereby moving said valve member.

3. The vacuum valve of claim 2 wherein movement of said actuator output member in a first direction causes said third toothed member to rotate in a first rotary direction for moving said valve member toward its first position, and wherein movement of said actuator output member in a second direction causes said third toothed member to rotate in a second rotary direction for moving said valve member toward its second position.

4. The vacuum valve of claim 3 wherein said first toothed member is a first toothed rack secured to said actuator output member, said second toothed member is second toothed rack formed on said valve member, and said third toothed member is a pinion gear meshed with both of said first and second toothed racks.

5. The vacuum valve of claim 4 wherein said valve member includes a shut-off piston having a first portion adapted for movement into and out of said slot and a second portion on which said second toothed rack is formed.

6. The vacuum valve of claim 5 further comprising a spring-biased cushioning piston retained in said second die block and having an end portion adapted to normally extend into said slot, whereby upon movement of said shut-off piston to said second position said shut-off piston contacts said cushioning piston and forcibly moves said cushioning piston in opposition to its spring-biasing for blocking said slot such that said cushioning piston dampens movement of said shut-off piston.

7. The vacuum valve of claim 1 further comprising a spring-biased cushioning piston retained in said second die block and having an end portion adapted to normally extend into said slot, whereby upon movement of said valve member to said second position said valve member contacts said cushioning piston and forcibly moves said cushioning piston in opposition to its spring-biasing for blocking said slot such that said cushioning piston cushions movement of said valve member.

8. The vacuum valve of claim 1 wherein said power-operated actuator is a hydraulic cylinder that is aligned such that its central axis is substantially transversed to a central axis of said valve member.

9. A vacuum valve adapted to be coupled with a die pair forming a mold cavity therebetween and separated by a parting line between the die pair, said vacuum valve comprising:

a first die block adapted to be secured to one die of the die pair and including a slot in fluid communication with the mold cavity and a central bore in fluid communication with said slot;

a piston positioned in said central bore of said first die block for movement between a first position permitting flow through said slot and a second position inhibiting flow of fluid through said slot;

a second die block adapted to be secured to the other die of the die pair and having a passageway in fluid communication with said slot and a vacuum source;

a power-operated actuator having a reciprocally movable output member;

a geared drive mechanism coupling said output member of said actuator to said piston for changing reciprocating movement of said actuator output member into reciprocating movement of said piston, said gear drive mechanism including a first toothed rack fixed to said actuator output member, a second toothed rack fixed to said piston, and a pinion gear meshingly coupled to both of said first and second rack members, whereby rectilinear movement of said first toothed rack in response to movement of said actuator output member causes corresponding rotation of said pinion gear which causes corresponding rectilinear movement of said second toothed rack for moving said piston; and a controller for controlling the reciprocation of said actuator output member.

10. The vacuum valve of claim 9 wherein movement of said actuator output member in a first direction causes said pinion gear to rotate in a first rotary direction for moving said piston toward its first position, and wherein movement of said actuator output member in a second direction causes said pinion gear to rotate in a second rotary direction from moving said piston toward its second position.

11. The vacuum valve of claim 10 wherein said pinion gear and said first toothed rack are supported for movement within said first die block.

* * * * *